US012623837B2

(12) United States Patent
Day et al.

(10) Patent No.: US 12,623,837 B2
(45) **Date of Patent: *May 12, 2026**

(54) SHIPPING CONTAINER HAVING FIBERGLASS FRAME

(71) Applicant: L&P Property Management Company, Carthage, MO (US)

(72) Inventors: Ryan Day, Hickory, NC (US); Nicholas A. Blank, Allegan, MI (US); Shannon L. Cline, Morganton, NC (US); Scott A Schnell, White Lake, MI (US)

(73) Assignee: L&P Property Management Company, Carthage, MO (US)

( * ) Notice: Subject to any disclaimer, the term of this patent is extended or adjusted under 35 U.S.C. 154(b) by 42 days.

This patent is subject to a terminal disclaimer.

(21) Appl. No.: 18/929,732

(22) Filed: Oct. 29, 2024

(65) Prior Publication Data

US 2025/0058965 A1 Feb. 20, 2025

Related U.S. Application Data

(63) Continuation of application No. 18/449,121, filed on Aug. 14, 2023, now Pat. No. 12,162,676.

(51) Int. Cl.

| | |
|---|---|
| ***B65D 90/00*** | (2006.01) |
| ***B65D 88/12*** | (2006.01) |
| ***B65D 90/20*** | (2006.01) |

(52) U.S. Cl.

CPC ..... *B65D 90/20* (2013.01); *B65D 88/127* (2013.01); *B65D 90/0026* (2013.01); *B65D 2588/12* (2013.01)

(58) Field of Classification Search

CPC .. B65D 90/20; B65D 88/127; B65D 90/0026; B65D 2588/12; B65D 11/10

See application file for complete search history.

(56) References Cited

U.S. PATENT DOCUMENTS

| | | | | |
|---|---|---|---|---|
| 3,138,398 | A * | 6/1964 | Silverman | B65D 90/0026 285/125.1 |
| 3,553,823 | A * | 1/1971 | Alfredsson | B65D 90/0026 228/173.6 |
| 3,966,075 | A * | 6/1976 | Schultz | B65D 88/025 220/8 |
| 4,505,402 | A * | 3/1985 | Gerhard | B65D 81/056 217/65 |

(Continued)

FOREIGN PATENT DOCUMENTS

| | | | |
|---|---|---|---|
| GB | 2433066 | * | 6/2005 |

*Primary Examiner* — Don M Anderson

(74) *Attorney, Agent, or Firm* — Wood Herron & Evans LLP

(57) ABSTRACT

A fiberglass frame for a shipping container supports dunnage or other support members for separating parts. The fiberglass frame comprises four hollow vertical edge members made of fiberglass, each extending between corner assemblies. The fiberglass frame further comprises a roof and a base each made of hollow fiberglass members. Each hollow fiberglass member extends between two corner assemblies. The corner assemblies are also made of fiberglass. The inherent lack of electrical conductivity in the frame prevents sensitive parts shipped in the dunnage or other support members from being damaged or compromised.

20 Claims, 5 Drawing Sheets

(56) References Cited

U.S. PATENT DOCUMENTS

| | | | | |
|---|---|---|---|---|
| 6,168,031 | B1 * | 1/2001 | Schmidt | B42F 15/0094 403/217 |
| 6,401,983 | B1 * | 6/2002 | McDonald | B65D 88/128 222/561 |
| 6,729,098 | B1 * | 5/2004 | Brennan, Jr. | B65D 90/0026 410/35 |
| 9,494,273 | B2 * | 11/2016 | Wang | F16B 7/18 |
| 9,809,381 | B2 * | 11/2017 | Oren | B65D 90/587 |
| D847,374 | S * | 4/2019 | Trudell | D12/41 |
| 2001/0038009 | A1 * | 11/2001 | Payne | B65D 90/18 220/1.5 |
| 2004/0262305 | A1 * | 12/2004 | Myers | B65D 90/0026 220/1.5 |
| 2006/0175323 | A1 * | 8/2006 | Myers | B65D 90/0026 220/1.5 |
| 2007/0000921 | A1 * | 1/2007 | Butler | B65D 88/121 220/1.5 |
| 2008/0066404 | A1 * | 3/2008 | Beard, Jr. | E04F 19/0486 52/287.1 |
| 2011/0303661 | A1 * | 12/2011 | Tujague, Sr. | B65D 90/0073 220/23.88 |
| 2014/0083554 | A1 * | 3/2014 | Harris | B65D 88/54 141/1 |
| 2014/0360891 | A1 * | 12/2014 | Kline | B65D 85/70 206/0.7 |
| 2016/0068338 | A1 * | 3/2016 | Vancampen | B65D 90/0006 220/640 |
| 2016/0264292 | A1 * | 9/2016 | Schoening | B65D 57/003 |
| 2018/0002106 | A1 * | 1/2018 | Horton | B65D 88/12 |
| 2018/0194548 | A1 * | 7/2018 | Helou, Jr. | B65D 90/0026 |
| 2019/0002196 | A1 * | 1/2019 | Lucas | B65D 90/022 |
| 2019/0185259 | A1 * | 6/2019 | Klinge | B65D 90/008 |
| 2019/0263578 | A1 * | 8/2019 | Beydoun | B01F 31/40 |

* cited by examiner

SHIPPING CONTAINER HAVING FIBERGLASS FRAME

CROSS REFERENCE TO RELATED APPLICATIONS

This application is a continuation of U.S. patent application Ser. No. 18/449,121 filed Aug. 14, 2023, which is fully incorporated herein.

TECHNICAL FIELD OF THE INVENTION

This invention relates generally to shipping containers and, more particularly, to containers for shipping vehicle parts.

BACKGROUND OF THE INVENTION

A large number of different container structures are utilized by manufacturers to ship a variety of different products to end users, which may be, for example, assembly plants. In the automobile industry, for example, an assembly plant assembling a particular automobile might utilize different parts from different manufacturers. These manufacturers ship their respective parts to the assembly plant in container structures where the parts are then removed from dunnage or other support members inside the container structure and assembled into a finished automobile. These containers are then shipped back empty to the respective part manufacturers to be refilled with parts, creating a closed loop system of reusable packaging. In addition, part manufacturers utilize containers within their respective facilities for work in process ("WIP"); the containers remaining in the part manufacturers facility.

One type of container structure is known in the industry as a rack. The rack is used to support fabric dunnage or other support members for storing, moving and transporting parts such as automobile parts. Known metal racks are manufactured using a cut and weld process, thereby creating a static product that cannot be easily disassembled or reassembled. The fact that the metal rack cannot be easily disassembled or reassembled limits future storage options and reuse of rack sections. The present invention allows for easy disassembly and future reassembly to minimize storage space while not in use. In addition, the present invention allows for the easy disassembly of a rack to utilize individual components on future designs, further saving both storage space and cost for an end user.

The weight of the container structure is of particular concern. Known racks are commonly made of metal. One disadvantage to using metal racks is that they are heavy. This weight has financial and environmental costs associated with the increased weight relative to the transportation of racks between facilities. It is more expensive to ship heavier containers and heavier cargo requires the use of more fossil fuels during shipment. In addition, WIP containers are moved throughout an end user's facility, increasing the number of points of contact with employees. A heavier container presents a much greater risk of personal injury to employees in the event a container falls over or is dropped.

The conductive material used to construct known metal racks is another concern. Because of this conductivity, the electric charge the metal rack may carry may damage certain electronic and/or sensitive parts, especially with the increase in electric vehicles being produced. Fiberglass is inherently nonconductive providing greater protection for electronic and/or sensitive parts.

The corrosive nature of the material used to construct known metal racks is another concern. Metal racks are subject to oxidation and corrosion, thus requiring painting or coating to prevent the long-term compromise of strength or the development of rust. This painting or coating can be chipped away, thus exposing the metal rack to corrosion and the development of rust. Metal racks are often stored outside when not in use due to limited inside storage space, increasing the likelihood of oxidation and exposure to moisture. Automobile parts can be compromised by rust and thus metal racks present a potential issue for part contamination. Fiberglass is inherently unaffected by moisture and is noncorrosive. Thus, fiberglass requires no painting or coating to prevent oxidation and rust. This difference becomes more important with the increase in the production of electronic vehicles.

The thermal conductivity of the material used to construct known metal racks is another concern. Metal racks have a high level of thermal conductivity. Metal racks are often stored outside when not in use, thus increasing their exposure to sunlight. Thermally conductive products present increased potential of personal injury with direct contact with skin. Fiberglass has low thermal conductivity presenting much less risk to persons coming in contact with the fiberglass.

The present invention solves these problems by reducing the weight of the rack container structure. Thus, there's no need for a heavy metal rack.

Therefore, there is a need for a rack container structure of lesser weight than known metal rack container structures that creates financial, environmental and safety benefits.

There is also a need for a rack container structure for supporting dunnage which is not conductive and therefore, will not damage sensitive automotive parts.

There is also a need for a rack container structure that can be easily disassembled and reassembled that provides storage and future reuse benefits.

There is also a need for a rack container that is noncorrosive in nature, preventing oxidation and rust that can damage sensitive parts.

There is also a need for a rack container that has low thermal conductivity, limiting the risk of personal injury from direct contact.

SUMMARY OF THE INVENTION

In one aspect, a fiberglass rack for a container holding product therein during shipment comprises a generally rectangular base, a generally rectangular roof and four edge members joining corner assemblies of the generally rectangular base and generally rectangular roof. The generally rectangular base has front and rear base members and side base members along with four corner assemblies. Each of the base members has a hollow interior, is made of fiberglass and is square in cross-section. The generally rectangular roof has front and rear roof members and side roof members along with four corner assemblies. Each of the roof members has a hollow interior, is made of fiberglass and is square in cross-section. The fiberglass rack further comprises four edge members. Each of the edge members joins one of the corner assemblies of the roof and one of the corner assemblies of the base. Each of the edge members has a hollow interior, is made of fiberglass and is square in cross section. Each of the eight corner assemblies of the rack is made of fiberglass and comprises a receiving member and a cover. Each of the corner assemblies of the rack is identical in configuration and made of fiberglass. Each of the corner assemblies comprises a receiving member and a cover, each made of fiberglass. Fasteners secure each of the corner assemblies to an edge member and base or roof members. The fasteners may be made of fiberglass, steel or any known material. Each of the receiving members of each of the corner assemblies receives portions of three different members of the container, including one edge member.

The container further comprises braces as part of the generally rectangular roof. The braces extend between the side roof members and support dunnage for holding, protecting and separating parts during shipment.

In a second aspect, a container for holding product therein during shipment comprises a fiberglass rack. The fiberglass rack comprises a generally rectangular base having hollow front and rear base members along with hollow side base members and four corner assemblies. Each of the hollow base members is rectangular in cross section and is made of fiberglass.

The fiberglass rack further comprises a generally rectangular roof having hollow front and rear roof members along with hollow side roof members and four corner assemblies. Each of the hollow roof members is rectangular in cross section and is made of fiberglass.

The fiberglass rack further comprises four hollow edge members. Each of the hollow edge members joins one of the corner assemblies of the base and one of the corner assemblies of the roof. Each of the hollow edge members is rectangular in cross section and is made of fiberglass. Each of the corner assemblies is made of fiberglass and comprises a receiving member and a cover. Fasteners secure the hollow members to the corner assemblies. The receiving member of each of the corner assemblies receives and retains portions of three different hollow members of the rack.

In a third aspect, a container for holding product therein during shipment comprises a rack for supporting dunnage. The rack comprises a generally rectangular base having hollow front and rear base members along with hollow side base members and four corner assemblies. Each of the hollow base members is rectangular in cross section and is made of fiberglass.

The fiberglass rack further comprises a generally rectangular roof having hollow front and rear roof members along with hollow side roof members and four corner assemblies. Each of the hollow roof members is rectangular in cross section and is made of fiberglass.

The fiberglass rack further comprises four hollow edge members. Each of the hollow edge members joins one of the corner assemblies of the base and one of the corner assemblies of the roof. Each of the hollow edge members is rectangular in cross section and is made of fiberglass. Each of the corner assemblies is made of fiberglass and comprises a receiving member and a cover. Fasteners secured the hollow members to the corner assemblies. The receiving member of each of the corner assemblies receives and retains portions of three different hollow members of the rack.

Although in the preferred embodiments, each of the edge members, roof members and base members are hollow, one or more members may be a solid or partially solid fiberglass member.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
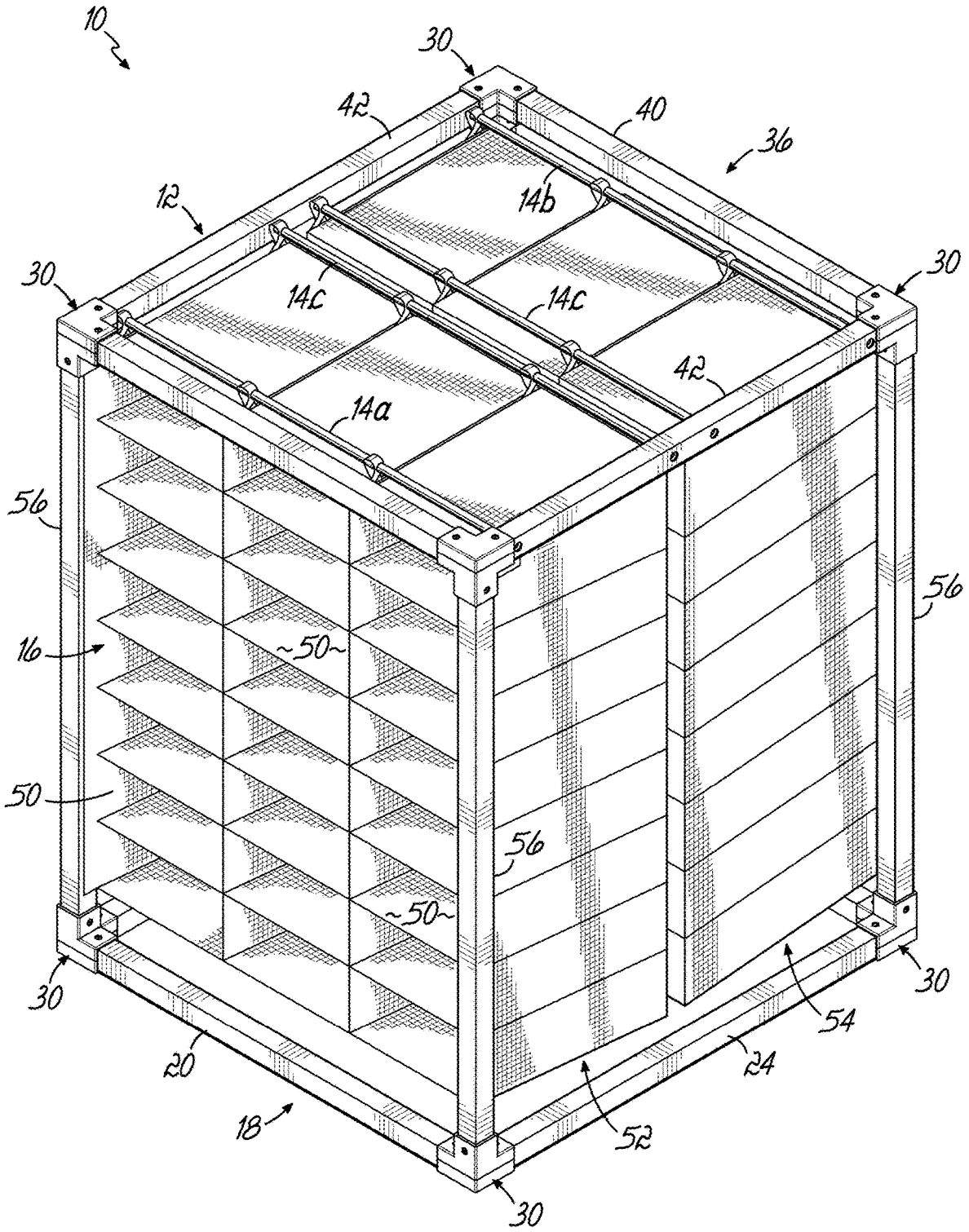
FIG. 1 is a front perspective view of a container incorporating a fiberglass rack according to the principles of the present invention.

Referring to FIG. 1, there is illustrated a container 10 incorporating the principles of the present invention. The container 10 comprises a rack 12 used to support braces 14 which support dunnage 16 for retaining and protecting parts during storage and shipment. The dunnage may be made of any known materials such as fabric or plastic or any combination thereof, for example. Although one configuration of dunnage 16 is illustrated in FIG. 1, the dunnage may be any known configuration.

Although four braces 14*a*-14*d* are illustrated supporting the dunnage 16, any number of braces may be used depending upon the dunnage to be supported by the braces. Similarly, the location of the braces 14*a*-14*d* is not intended to be limited by the drawings. Any number of braces may be used at any desired locations. The dunnage 16 may be suspended by the braces in any known manner.

Figure 2:
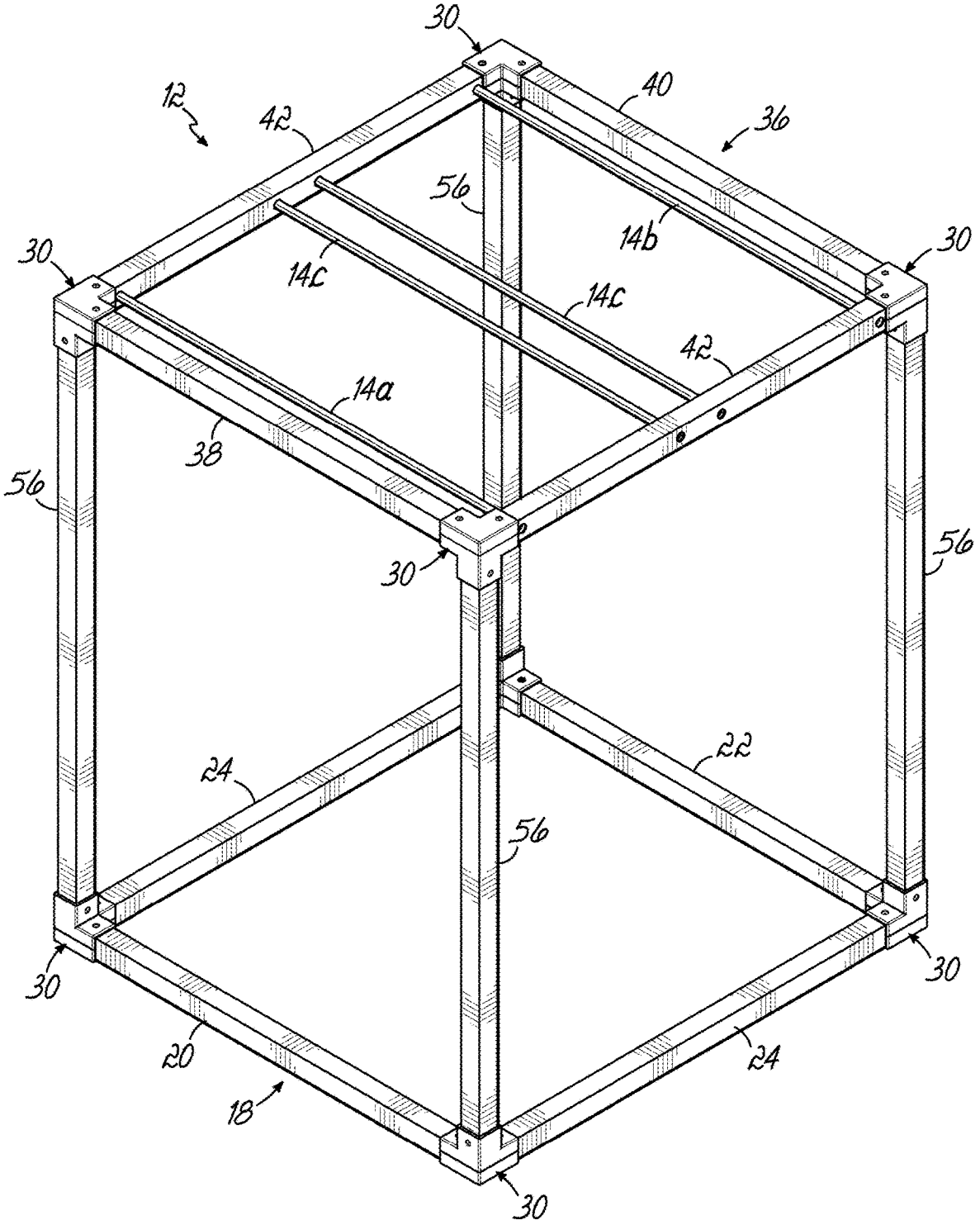
FIG. 2 is a front perspective view of the rack of the container of FIG. 1.
Figure 4:
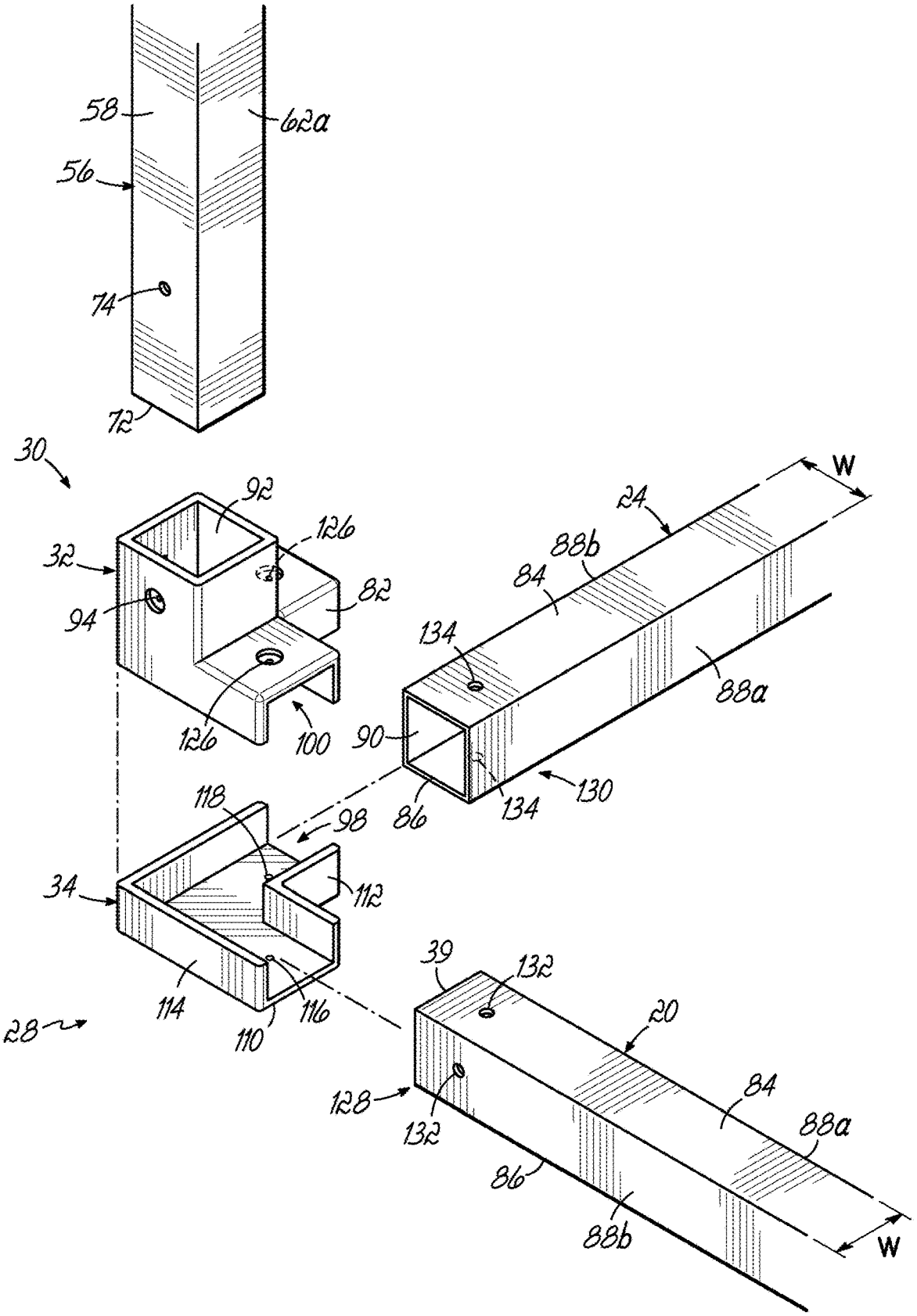
FIG. 4 is a disassembled perspective view of a lower corner of the rack according to the principles of the present invention.

FIG. 2 illustrates the details of the rack 12. The rack 12 comprises a generally rectangular base 18 comprising a front base member 20, a rear base member 22 and two side base members 24, each made of fiberglass. As best shown in FIG. 4, each of the base members 20, 22 and 24 has a top wall 84, a bottom wall 86, an inner side wall 88*a* and an outer side wall 88*b* defining a hollow interior 90. The walls 84, 86, 88*a* and 88*b* define a square cross-sectional configuration. As best shown in FIG. 4, the linear distance between outer surfaces of the side walls 88*a*, 88*b* define a width "W" of the base member 20, 22 or 24. Each of the hollow base members 20, 22 and 24 are preferably the same size.

The generally rectangular base 18 further comprises four identical corner assemblies 30. Each of the corner assemblies 30 comprises a receiving member 32 and a cover 34. The receiving member 32 and cover 34 are preferably each made of fiberglass.

Figure 3A:
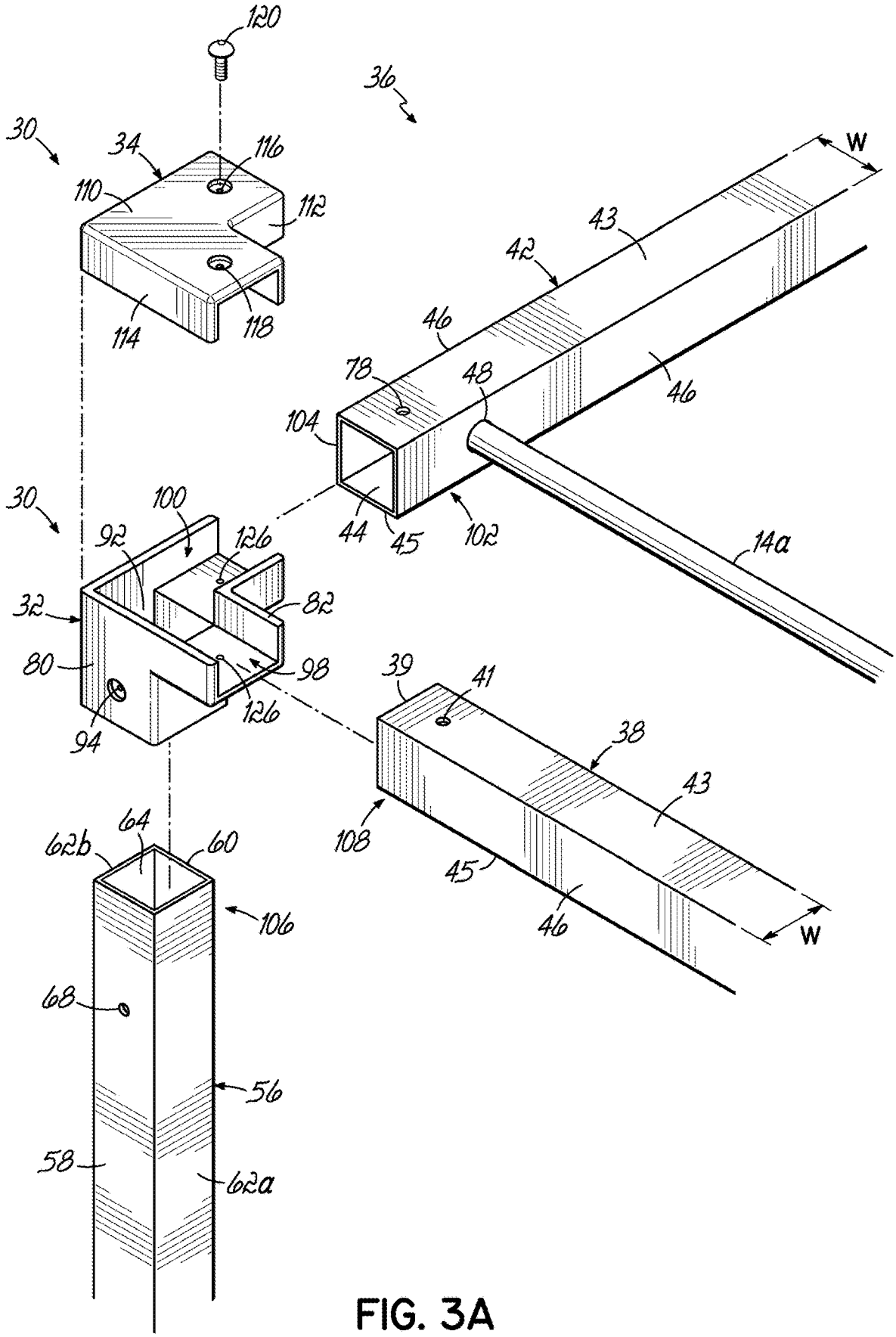
FIG. 3A is a disassembled perspective view of a corner of the rack according to the principles of the present invention.

As best shown in FIG. 2, the rack 12 comprises a generally rectangular roof 36 comprising a front roof member 38, a rear roof member 40 and two side roof members 42, each made of fiberglass. As best shown in FIG. 3A, each of the roof members 38, 40 and 42 has a top wall 43, a bottom wall 45 and inner and outer side walls 46 defining a hollow interior 44 and is square in cross-section. The linear distance between outer surfaces of the side walls 46 defines a width "W" of the hollow roof members 38, 40 and 42. Each of the hollow roof members 38, 40 and 42 are preferably the same size. Each of the side roof members 42 has two outer ends 102, each outer end 102 having an outer edge 104.

The generally rectangular roof 18 further comprises four corner assemblies 30 as described above. As shown in FIG. 3A, proximate an outer edge 39 of the front roof member 38, a threaded opening 41 extends through each of the top and bottom walls 43, 45, respectively, of the front roof member 38 at each end (only one being shown). Similarly, a threaded opening 78 extends through each of the top and bottom walls 43, 45 of each of the side roof members 42 at each end (only one being shown).

The generally rectangular roof 18 further comprises a front brace 14*a* extending between the side roof members 42. As best shown in FIG. 3A, the front brace 14*a* extends through an opening 48 in an inner wall 46 of each of the side roof members 42 and extends into the hollow interior 44 of the side roof member 42 on each end.

As best shown in FIG. 2, the generally rectangular roof 18 further comprises a rear brace 14*b* and two middle braces 14*c*, each extending between the side roof members 42 and supported by the side roof members 42 as described above. As best shown in FIG. 1, the front brace 14*a* and forward-most middle brace 14*c* support a first section 52 of dunnage 16 in the form of three columns of dunnage compartments 50 for holding parts and preventing parts from damage during shipment of the container 10. As shown in FIG. 1, the rear brace 14*b* and rearmost middle brace 14*c* support a second section 54 of dunnage 16 in the form of three columns of dunnage compartments 50 for holding parts and preventing parts from damage during shipment of the container 10.

Figure 3B:
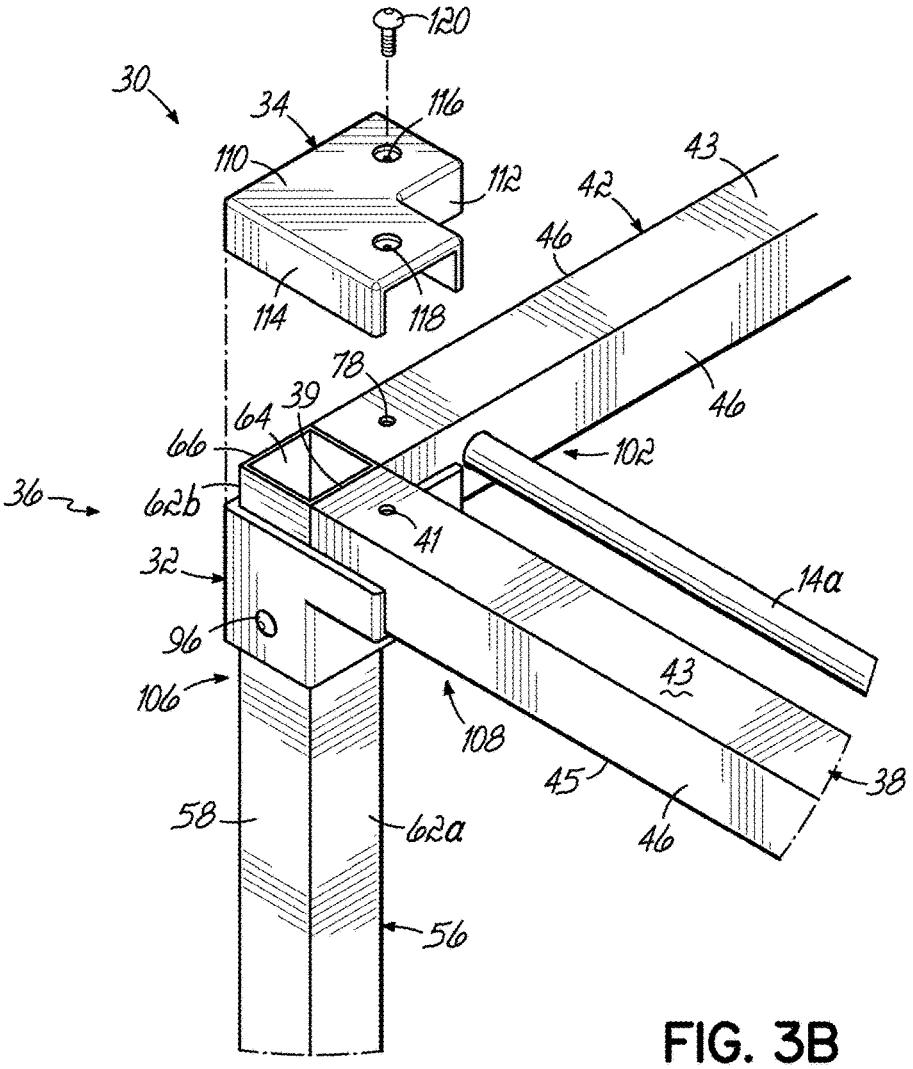
FIG. 3B is a partially assembled perspective view of the corner of the rack of FIG. 3A.

The rack 12 further comprises four edge members 56 which are vertically oriented when the rack 12 is fully assembled and oriented as shown. Each of the edge members 56 extends between one of the corner assemblies 30 of the roof 36 and a corresponding corner assembly 30 of the base 18. As best shown in FIGS. 3A and 3B, each of the edge members 56 has a front wall 58, a rear wall 60, an inner side wall 62*a* and an outer side wall 62*b* defining a hollow interior 64. The walls 58, 60, 62*a* and 62*b* define a square cross-sectional configuration. As shown in FIG. 3A, proximate an upper edge 66 of the edge member 56 a threaded opening 68 extends through the front wall 58. As shown in FIG. 4, proximate a lower edge 72 of the edge member 56 a threaded opening 74 extends through the front wall 58 of the edge member 56.

Figure 3C:
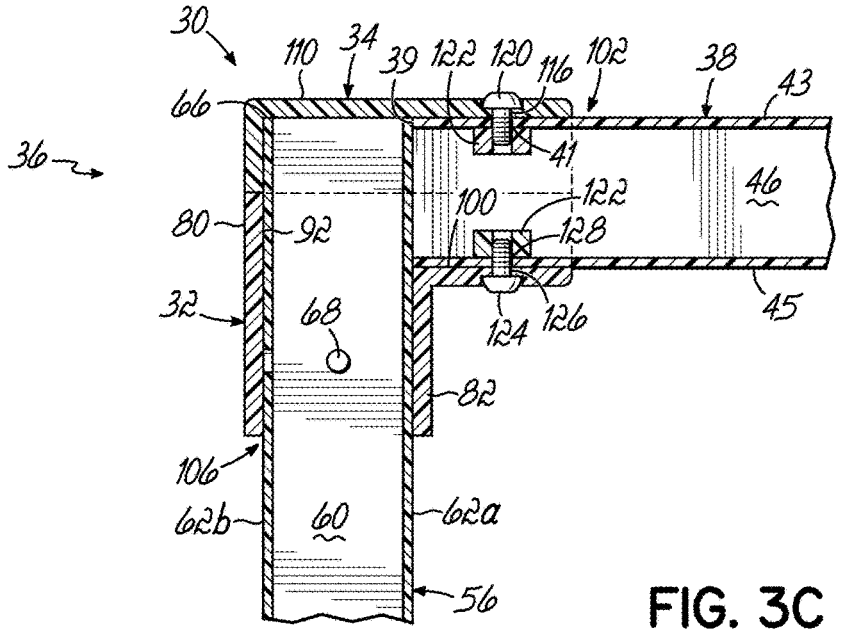
FIG. 3C is a cross-sectional view, of the corner of the rack of FIG. 3B fully assembled.

FIGS. 3A, 3B and 3C show a connection between the front roof member 38, one of the side roof members 42, one of the edge members 56 and one of the corner assemblies 30 of the roof 36. Each of the top four rack corners is joined in approximately the same manner.

Referring now to FIG. 3A, the receiving member 32 of the corner assembly 30, is preferably a unitary member made of fiberglass. As shown in FIG. 3A, the receiving member 32 has an L-shaped outer wall 80 and an L-shaped inner wall 82. The linear distance between inner surfaces of the L-shaped outer wall 80 and an L-shaped inner wall 82 defines a slightly larger or identical width as the width "W" of the front, rear and side roof and base members as described above.

As shown in FIG. 3A, an outer end 108 of the front roof member 38 is inserted into a first channel 98 defined between the receiving member 32 and cover 34 of the corner assembly 30. The first channel 98 is sized to receive and retain the outer end 108 of the front roof member 38. As shown in FIG. 3B, the outer edge 39 of the front roof member 38 abuts the side wall 62*a* of the edge member 56 upon full assembly of the corner. Likewise, as shown in FIG. 3C, the top wall 43 of the front roof member 38 aligns with the upper edge 66 of the edge member 56.

As shown in FIG. 3A, an outer end 102 of the side roof member 42 is inserted into a second channel 100 defined between the receiving member 32 and cover 34 of the corner assembly 30. The second channel 100 is sized to receive and retain the outer end 102 of the side roof member 42. As shown in FIG. 3B, the outer edge 104 of the side roof member 42 abuts the rear wall 60 of the edge member 56 upon full assembly of the corner. Likewise, as shown in FIG. 3C, the top wall 43 of the side roof member 42 aligns with the upper edge 66 of the edge member 56.

As shown in FIG. 3A, an upper end 106 of the edge member 56 is inserted into a passage 92 in the receiving member 32 of the corner assembly 30. As shown in FIG. 3A, a threaded opening 94 extending through the L-shaped outer wall 80 of the receiving member 32 of the corner assembly 30 is aligned with the threaded opening 68 extending through the front wall 58 of the edge member 56. As shown in FIG. 3B, a threaded bolt 120 extends through the threaded openings 94, 68 to secure the edge member 56 inside the passage 92 of the receiving member 32 of the corner assembly 30. A nut (not shown) is secured to the end of threaded bolt 120.

Referring now to the cover 34 of the corner assembly 30, the cover 34 is preferably a unitary member made of fiberglass. The cover 34 has a top portion 110, an L-shaped inner wall portion 112 extending downwardly from the top portion 110 and an L-shaped outer wall portion 114 extending downwardly from the top portion 110. A first threaded opening 116 extends through the top portion 110 of the cover 34 and aligns with the threaded opening 78 of the side roof member 42. A second threaded opening 118 extends through the top portion 110 of the cover 34 and aligns with the threaded opening 41 of the front roof member 38.

A threaded fastener 120 extends through the first threaded opening 116 of the cover 34 and through the threaded opening 78 extending through the top wall 43 of the side roof member 42 to secure the cover 34 to the side roof member 42 using a nut 122. Similarly, as shown in FIG. 3C, a second threaded fastener 120 extends through a threaded opening 126 extending through the receiving member 32 and through the threaded opening 78 extending through the bottom 45 of the side roof member 42 to secure the receiving member 32 to the side roof member 42 using a nut 122.

Another threaded fastener 120 extends through the second threaded opening 118 of cover 34 and through the threaded opening 41 extending through the top wall of the front roof member 38 to secure the cover 34 to the front roof member 38 with nut 122. Similarly, as shown in FIG. 3C, a second threaded fastener 120 extends through a threaded opening 126 extending through the receiving member 32 and through the threaded opening 41 extending through the bottom 45 of the front roof member 38 to secure the receiving member 32 to the front roof member 38 using a nut 122.

FIG. 4 shows a connection between the front base member 20, one of the side base members 24, one of the edge members 56 and one of the corner assemblies 30 of the base 28. As shown in FIG. 4, proximate a lower edge 72 of the edge member 56 a threaded opening 74 extends through the front wall 58 of the edge member 56. The edge member 56 fits inside the passage 92 of the receiving member 32 of the corner assembly 30. A threaded bolt 120 extends through the threaded opening 94 in the receiving member 32 and a nut 122 is secured to the end of the threaded bolt 120. The threaded bolt 120 and nut 122 secure the leg 28 to the receiving member 32 of the corner assembly 30.

As shown in FIG. 4, an outer end 128 of the front base member 20 is inserted into a second channel 100 defined between the receiving member 32 and cover 34 of the corner assembly 30. The second channel 100 is sized to receive and retain the outer end 108 of the front base member 20. Similarly, an outer end 130 of the side base member 24 is inserted into a first channel 100 defined between the receiving member 32 and cover 34 of the corner assembly 30. The first channel 98 is sized to receive and retain the outer end 130 of the side base member 24.

A threaded fastener 120 extends through the first threaded opening 116 of the cover 34 and through a threaded opening 132 extending through the bottom wall 43 of the front base member 20 to secure the cover 34 to the front base member 20 using a nut 122. Similarly, as shown in FIG. 4, a second threaded fastener 120 extends through a threaded opening 126 extending through the receiving member 32 and through the threaded opening 132 extending through the top 45 of the front base member 20 to secure the receiving member 32 to the front base member 20 using a nut 122.

Another threaded fastener 120 extends through the second threaded opening 118 of cover 34 and through the threaded opening 134 extending through the bottom wall of the front base member 20 to secure the cover 34 to the front base member 20 with nut 122. Similarly, as shown in FIG. 4, a second threaded fastener 120 extends through a threaded opening 126 extending through the receiving member 32 and through a threaded opening 134 extending through the bottom 45 of the side base member 24 to secure the receiving member 32 to the side base member 24 using a nut 122.

Although the openings and fasteners are shown in certain locations to secure the corner assemblies to the base members or roof members, they may be in other locations. The drawings are not intended to be limiting.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A fiberglass rack for a container for holding product therein during shipment, the fiberglass rack comprising:

a generally rectangular base having front and rear base members along with side base members and four corner assemblies, each of the base members having a hollow interior;

a generally rectangular roof having front and rear roof members along with side roof members and four corner assemblies; each of the roof members having a hollow interior;

four edge members, each of the edge members joining one of the corner assemblies of the base and one of the corner assemblies of the roof, each of the edge members having a hollow interior;

wherein each of the corner assemblies is identical and comprises a receiving member and a cover.

2. The fiberglass rack of claim 1, wherein fasteners secure the base and roof members to the corner assemblies.

3. The fiberglass rack of claim 2, wherein each of the receiving members of each of the corner assemblies receives portions of three different members of the container therein.

4. The fiberglass rack of claim 2, wherein each of the receiving members of each of the corner assemblies receives a portion of one of the edge members and portions of two different members of the rack therein.

5. The fiberglass rack of claim 1, wherein threaded fasteners extend through portions of the corner assemblies and into the members.

6. The fiberglass rack of claim 1 further comprising braces for supporting dunnage inside the fiberglass rack.

7. A container for holding product therein during shipment, the container comprising:

a fiberglass rack comprising a generally rectangular base having hollow front and rear base members along with hollow side base members and four corner assemblies, each of the hollow base members being made of fiberglass;

a generally rectangular roof having hollow front and rear roof members along with hollow side roof members and four corner assemblies; each of the hollow roof members being made of fiberglass;

four hollow edge members, each of the hollow edge members joining one of the corner assemblies of the base and one of the corner assemblies of the roof, each of the edge members being made of fiberglass;

wherein each of the corner assemblies is made of fiberglass and comprises a receiving member and a cover.

8. The container of claim 7, wherein fasteners secure the hollow base and roof members to the corner assemblies.

9. The container of claim 8, wherein each of the receiving members of each of the corner assemblies receives portions of three different hollow members of the rack therein.

10. The container of claim 8, wherein each of the receiving members of each of the corner assemblies receives a portion of one of the hollow edge members and portions of two different hollow members of the rack therein.

11. The container of claim 7, wherein threaded fasteners extend through portions of the corner assemblies and into the members.

12. The container of claim 7, further comprising braces extending between the hollow roof side members to support dunnage.

13. A container for holding product therein during shipment, the container comprising:

a rack comprising a generally rectangular base having hollow front and rear base members along with hollow side base members and four corner assemblies, each of the hollow base members being made of fiberglass;

a generally rectangular roof having hollow front and rear roof members along with hollow side roof members and four corner assemblies; each of the hollow roof members being made of fiberglass;

four hollow edge members joining one of the corner assemblies of the base and one of the corner assemblies of the roof, each of the hollow edge members being made of fiberglass;

wherein each of the corner assemblies is made of fiberglass and comprises a receiving member and a cover.

14. The container of claim 13 wherein each of the edge members is square in cross section.

15. The container of claim 13, wherein fasteners secure the hollow base and roof members to the corner assemblies.

16. The container of claim 14, wherein each of the receiving members of each of the corner assemblies receives portions of three different hollow members of the rack therein.

17. The container of claim 14, wherein each of the receiving members of each of the corner assemblies receives a portion of one of the hollow edge members and portions of two different hollow members of the rack therein.

18. The container of claim 13, wherein threaded fasteners extend through portions of the corner assemblies and into the members.

19. The container of claim 13, further comprising braces extending between the hollow roof side members to support dunnage.

20. The container of claim 13, further comprising dunnage supported by braces.

* * * * *